US007927471B2

(12) United States Patent
Shinomiya et al.

(10) Patent No.: US 7,927,471 B2
(45) Date of Patent: Apr. 19, 2011

(54) THREE-DIMENSIONAL ELECTRODE FOR ELECTROLYSIS, ION EXCHANGE MEMBRANE ELECTROLYTIC CELL AND METHOD OF ELECTROLYSIS USING THREE-DIMENSIONAL ELECTRODE

(75) Inventors: Yoshitsugu Shinomiya, Tamano (JP); Masahiro Ohara, Tamano (JP); Keiji One, Tamano (JP); Tsuneo Tokumori, Tamano (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 1239 days.

(21) Appl. No.: 11/525,941

(22) Filed: Sep. 25, 2006

(65) Prior Publication Data

US 2007/0068799 A1 Mar. 29, 2007

(30) Foreign Application Priority Data

Sep. 26, 2005 (JP) ..... 2005-278198
Sep. 6, 2006 (JP) ..... 2006-241731

(51) Int. Cl.
*C25B 9/00* (2006.01)

(52) U.S. Cl. ..... 204/288; 204/289

(58) Field of Classification Search ..... 204/288–289
See application file for complete search history.

(56) References Cited

U.S. PATENT DOCUMENTS 5,360,526 A * 11/1994 Arimoto et al. ..... 204/242
7,045,041 B2 * 5/2006 Katayama ..... 204/252

FOREIGN PATENT DOCUMENTS

| | | |
|---|---|---|
| JP | 57-164990 | 10/1982 |
| JP | 63-53272 | 10/1988 |
| JP | 11-343106 | 12/1999 |
| JP | 2000-515106 | 11/2000 |
| JP | 2004-300543 | 10/2004 |
| WO | WO 95/00701 | 1/1995 |

* cited by examiner

*Primary Examiner* — Arun S Phasge
(74) *Attorney, Agent, or Firm* — Young & Thompson

(57) ABSTRACT

A three-dimensional electrode with higher strength and higher toughness is provided. The three-dimensional electrode is fabricated by bending a plurality of snicks which are formed in a plate-like electrode substrate toward the same direction. The stabilization of the positional relation among the elements generated by the three-dimensional electrode neither mechanically damages the membrane nor causes the insufficient current supply. The three-dimensional electrode is preferably used for brine electrolysis and white liquor electrolysis.

3 Claims, 8 Drawing Sheets

THREE-DIMENSIONAL ELECTRODE FOR ELECTROLYSIS, ION EXCHANGE MEMBRANE ELECTROLYTIC CELL AND METHOD OF ELECTROLYSIS USING THREE-DIMENSIONAL ELECTRODE

BACKGROUND OF THE INVENTION (a) Field of the Invention

The present invention relates to a three-dimensional electrode for electrolysis having elastic electroconductive sections, an electrolytic cell employing the three-dimensional electrode, and a method of electrolysis using the three-dimensional electrode.

(b) Description of the Related Art

Electrolysis industry including chloroalkali electrolysis has an important-role-in-material industry as its typical industry. In addition to this important role, energy-saving is earnestly required in a country where energy cost is high such as in Japan because the energy consumed in the chloroalkali electrolysis is higher.

The chloroalkali electrolysis has been converted from the mercury method into the ion exchange membrane method through the diaphragm method in order to solve the environmental problems and to achieve the energy-saving, and actually the energy-saving by about 40% has been attained in about 25 years. However, even the energy-saving to this extent is unsatisfactory, and as far as the present method is used, the further electric power saving is impossible while the cost of the energy or the electric power occupies about half of the total manufacture cost.

In the electrolytic cell mounting a hydrogen-generating cathode used for brine electrolysis, cell voltage is reduced by disposing an anode, an ion exchange membrane and the hydrogen-generating cathode in intimate contact with one another. However, in a large-scaled electrolytic cell with an electrolytic area reaching several square meters where an anode and a cathode are made of rigid materials, an inter-electrode distance can be hardly maintained at a specified value by intimately contacting both electrodes on an ion exchange membrane.

In order to reduce the inter-electrode distance or a distance between the electrode and the corresponding electrode current collector or to maintain these at a nearly fixed value, an electrolytic cell using an elastic material therein is proposed.

The elastic material includes a non-rigid material such as a woven fabric, a non-woven fabric and a mesh, and a rigid material such as a blade spring.

The use of the non-rigid material arises such problems that the inter-electrode distance becomes non-uniform due to the partial deformation of the non-rigid material generated by the undue pressing from the counter-electrode side and the fine wires of the non-rigid material stick to an ion exchange membrane. The rigid material such as the blade spring inconveniently damages the ion exchange membrane, and reuse thereof may become impossible due to plastic deformation.

Various methods have been proposed for pressing the electrodes toward the ion exchange membrane in the ion exchange membrane electrolytic cell such as an electrolytic cell for brine electrolysis because the lower-voltage operation is desirable by intimately contacting the anode and the cathode with the ion exchange membrane.

As described, the structural characteristic of the electrolytic cell sandwiching the ion exchange membrane between the anode and the cathode is that, in order to prevent the damage of the ion exchange membrane by means of the uniform contact between the electrode and the ion exchange membrane and to maintain the inter-electrode distance to be minimum, at least one of the electrodes can freely move in the direction of the inter-electrode distance so that the electrode is pressed by an elastic element to adjust a holding pressure.

The elastic element includes a knitted fabric and a woven fabric made of metal wires or a structure prepared by stacking the fabrics, or by three-dimensionally knitting the fabrics or by three-dimensionally knitting the fabrics followed by crimp processing, and a non-woven fabric made of metal fibers, a coil hopper (spring) and a blade spring. These examples have spring elasticity of some kind.

On the other hand, the blade spring and the metal mesh are used for smoothly conducting the power supply from the current collector to the electrode in an industrial electrolytic cell such as that for brine electrolysis.

As described, however, the blade spring and the metal mesh are so rigid as to damage the ion exchange membrane and may provide the insufficient electric connection due to its lower deformation rate.

In order to solve these problems, an electrolytic cell is disclosed in JP-B-63(1988)-53272 (FIGS. 1 to 8) in which a cathode is uniformly pressed toward a diaphragm to intimately contact the respective elements with one another by mounting a metal coil in place of the metal mesh between the cathode and the cathode end wall.

The extremely small diameter and the higher deformation rate of the metal coil sufficiently contact the respective elements with one another so that the stable operation of the electrolytic cell is possible.

However, in the electrolytic cell disclosed in the above JP-B-63(1988)-53272, the metal coil in addition to the anode and the cathode is mounted in the electrolytic cell so that the number of the elements increases and the cathode, if rigid, cannot provide the sufficient adhesion.

In order to solve the defects, an electrode consisting of a metal coil which supports electrode catalyst or another electrode formed by winding the metal coil around a anti-resistant frame has been proposed (JP-A-2004-300543). This technique is characterized by using the metal coil as the electrode itself and not by using the metal coil for pressing the electrode toward the ion exchange membrane. This electrode has an advantage that caustic soda can be produced with a higher efficiency because the higher strength and the higher toughness of the electrode retain its shape for a longer period of time so that the ion exchange membrane is neither mechanically damaged nor excessively deformed to result in the insufficient power supply. In spite of the above-described advantages, this electrode has a disadvantage of requiring a lot of manufacturing labor.

In the meantime, for the effective utilization of lumber resources, high yield production of chemical pulp is important. A polysulfide cooking process is proposed as a tool of high yield production of kraft pulp which is a mainstream of the chemical pulp. The cooking liquor in the polysulfide cooking process is prepared by oxidizing alkali aqueous solution containing sodium sulfide or white liquor with molecular oxygen such as air under presence of catalyst such as active carbon.

In this method, the polysulfide cooking liquor having polysulfide concentration of about 5 g/liter can be obtained at an inversion rate of about 60% and a selection rate of about 60% based on the sulfide ion. However, in this method, thiosulfate ion which does not at all contribute to the cooking is collaterally produced so that the cooling liquor containing the higher concentration polysulfide ion is hardly prepared at the higher selection rate.

The polysulfide ion herein also referred to as "polysulfide sulfur" includes, for example, sulfur having a valence "0" in sodium polysulfide ($Na_2S_x$), that is, (x-1) atoms of the sulfur.

On the other hand, WO95/00701 discloses a method of electrolytically preparing polysulfide cooking liquor. In this method, an anode is used which is fabricated by coating a substrate with an oxide of ruthenium, iridium, platinum or palladium. Specifically, a three-dimensional mesh electrode having a substrate prepared by combining a plenty of expanded metals is disclosed.

JP-A-2000-515106 also discloses a method of electrolytically preparing polysulfide cooking liquor in which a porous anode made of carbon, especially accumulated carbon fibers having a diameter of 1 to 300 μm is used.

When starting electrolyte contains impurities, the above electrode used for the white liquor electrolysis (electrolytic preparation of polysulfide cooking liquor) or used for the other electrolysis, the impurities adhere to the electrode surface to increase the cell voltage. In order to avert this problem, the electrode is required to be washed, and at worst periodically replaced.

The impurities deposited on the interior of porous material are not sufficiently removed by physical washing, and chemical washing using acid or chelate is required for removing the impurities so that equipment expenses increase and the handling thereof is burdensome.

When the electrolyte containing the impurities is electrolyzed by using the conventional electrode, the impurities are deposited on the electrode surface and exert adverse influence to the membrane so that an operation for a longer period of time is hindered.

SUMMARY OF THE INVENTION

An object of the present invention is to provide a three-dimensional electrode for electrolysis and an ion exchange membrane electrolytic cell which overcome the above-mentioned drawbacks of the prior art.

Another object of the present invention is to provide a method of electrolysis which enables stable electrolysis for a longer period of time and reduces the deposition on the electrode surface even when the method is used for the electrolysis of the electrolyte containing the impurities The present invention provides as a first aspect thereof, a three-dimensional electrode for electrolysis including a plate-like metal electrode substrate supporting electrode catalyst and having a plurality of snicks, and a plurality of elastic electroconductive sections which are formed by bending the plurality of the snicks toward the same direction with respect to the electrode substrate.

The present invention also provides, as a second aspect thereof, an ion exchange electrolytic cell including an anode chamber including an anode and a cathode chamber including a cathode separated by an ion exchange membrane and an anode current collector and a cathode current collector, at least one of the anode and the cathode being a three-dimensional electrode for electrolysis including a plate-like metal electrode substrate supporting electrode catalyst and having a plurality of snicks: and a plurality of elastic electroconductive sections which are formed by bending the plurality of the snicks toward the same direction with respect to the electrode substrate, and the electrode substrate being in tight contact with the ion exchange membrane, and the elastic electroconductive sections being in contact with at least one of the anode current collector and the cathode current collector.

The present invention also provides, as a third aspect thereof, a method of electrolysis including the steps of, mounting, in an ion exchange membrane electrolytic cell divided into an anode chamber accommodating an anode and a cathode chamber accommodating a cathode by means of an ion exchange membrane, a three-dimensional electrode acting as at least one of the anode and the cathode which includes a plate-like metal electrode substrate supporting electrode catalyst and having a plurality of snicks, and a plurality of elastic electroconductive sections which are formed by bending the plurality of the snicks toward the same direction with respect to the electrode substrate such that the metallic electrode substrate is in tight contact with the ion exchange membrane and the elastic electroconductive sections are in contact with current collector; and electrolyzing electrolyte containing an impurity in the ion exchange membrane electrolytic cell.

The three-dimensional electrode of the present invention can be fabricated only by forming a plurality of the snicks in the plate-like metallic electrode substrate, and bending the snicks toward the same direction, thereby forming the elastic electroconductive sections. Further, the electrode with the higher strength and the higher toughness can be obtained because the elastic electroconductive sections provide the resilience to the entire electrode.

The ion exchange membrane electrolytic cell mounting the three-dimensional electrode can perform the smooth electrolysis under the stable positional relationship among the elements of the electrolytic cell by means of the higher strength and the higher toughness of the three-dimensional electrode.

In order to perform the white liquor electrolysis using the above ion exchange membrane electrolytic cell, for example, current is supplied to both of the electrodes while white liquor or its diluted solution containing the impurities is supplied to the anode chamber and the diluted caustic soda aqueous solution to the cathode chamber. The stabilization of the positional relation among the elements obtained by the high strength and the higher toughness of the three-dimensional electrode neither mechanically damages the membrane nor causes the insufficient current supply due to the excessive deformation, thereby producing the polysulfide cooking liquor with higher efficiency.

The above and other objects, features and advantages of the present invention will be more apparent from the following description.

PREFERRED EMBODIMENTS OF THE INVENTION

Figure 1A:
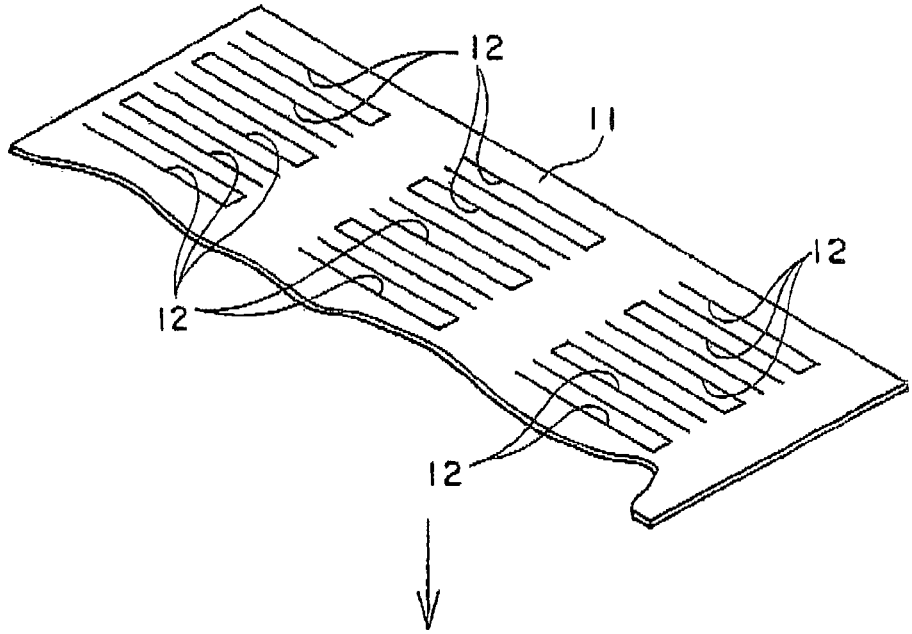
FIG. 1*a* is a partially broken perspective view showing an electrode substrate having snicks.

The three-dimensional electrode of the present invention is fabricated by forming a plurality of the snicks in the plate-like metal electrode substrate, and bending the snicks toward the same direction with respect to the electrode substrate for forming the elastic electroconductive sections, The bending angle (θ) can be arbitrary determined in a range of $0°<\theta<180°$, and preferably 10° or more and 90° or less, and more preferably 30° or more and 80° or less.

When the elastic electroconductive sections formed by bending the snicks is inward pressed, for example, between the ion exchange membrane and the electrode current collector, the electroconductive sections obtain the resilience to be retained therebetween.

Thereby, no resilient elements other than the electrode are required to be mounted in the electrolytic cell so that the electrode itself, in addition to the function of the electrode, resiliently presses the electrode toward the membrane. Accordingly, an effect of tight and uniform contact between the electrode and the membrane can be generated. Further, the electroconductive sections which generate the resilience are mot in contact with the membrane so that the membrane is never damaged.

When the front ends of the plurality of the electroconductive sections are bent to form the connection members which are then contacted with or welded to the current collector, the same number of the current-supplying paths as that of the electroconductive sections can be secured.

Different from the ordinary porous electrode substrate, the effective electrode area does not decrease because the electroconductive sections themselves have the electrode function.

The three-dimensional electrode of the present invention is desirably made of metal or alloy such as nickel, nickel alloy, stainless steel having the excellent durability or copper alloys of which an entire surface is electroless-plated with nickel. These metals or alloys have smaller resistivity. The electrode substrate may be a non-porous sheet or a porous object such as expanded metal.

The electrode catalyst is supported on the electrode substrate by plating Raney nickel catalyst thereon by using nickel in the dispersion state.

While the snicks are preferably rectangular, any other shape is possible such as square, half-circle, tapered trapezoid and trapezoid thickened toward the end. While the snicks may be randomly formed in the electrode substrate, they are desirably formed matrix-like.

The ratio of the snicks with respect to the entire surface of the electrode substrate is desirably 5 to 60%, and more desirably 15 to 30%. The resilience and the electroconductivity may be deficient when the ratio is below 5%, and the strength of the entire electrode may be deficient and the increase of the elastic electroconductive sections which depart from the ion exchange membrane may invite the resistance increase to generate the energy loss when the ratio exceeds 60%.

While the surface of the electrode substrate after the formation of the elastic electroconductive sections may remain flat, it may be subjected to the knurling, the louver formation and the corrugate formation.

The electrolysis reaction in the electrolytic cell of the present invention is desirably the generation of alkali hydroxide (caustic soda) by the electrolysis of chloroalkali (sodium chloride), and further includes the electrolysis of solution containing impurities such as the formation of polysulfide ion by the electrolysis of white liquor containing the above impurities, especially the electrolytic preparation of polysulfide cooking liquor. However, the reaction is not restricted thereto provided that the three-dimensional electrode can be used. The reaction further includes a waste acid recovery reaction and a seawater electrolysis reaction.

For accommodating the three-dimensional electrode in the electrolytic cell, as described earlier, the electrode is mounted such that the electrode is inward pressed between the ion exchange membrane and the electrode current collector (ordinarily, the current collector presses the three-dimensional electrode including the electroconductive sections toward the membrane), thereby providing the resilience to the three-dimensional electrode to make the tight contact between the electrode and the membrane.

A perfluorocation exchange membrane having, as an ion exchange group, carboxylic acid, sulfonic acid or a combination thereof which is used in the current ion exchange membrane brine electrolysis may be used also in the present, invention.

Current is supplied to both of the electrodes while brine is supplied, to the anode chamber and the diluted caustic soda aqueous solution is supplied to the cathode chamber, for example, for conducting the brine electrolysis by using the electrolytic cell having the above configuration.

The stabilization of the positional relation among the elements by the high strength and the higher toughness of the three-dimensional electrode neither mechanically damages the membrane nor causes the insufficient current supply due to the excessive deformation, thereby producing the caustic soda or the like with higher efficiency.

Now, an embodiment of the present invention is more specifically described referring to the annexed drawings. However, the present invention is not restricted thereto.

As shown in FIG. 1*a,* 15 pieces of oblong snicks 12 aligned in five rows each having three pieces and orientating toward the same direction are formed on a non-porous metallic electrode substrate 11. The two adjacent snicks belonging to the different rows face to the opposite directions.

Then, the snicks 12 are bent, to the same direction with respect to the electrode substrate 11, or downward the electrode substrate in the drawing, to form elastic electroconductive sections 13. Simultaneously, the front ends of the elastic electroconductive sections 13 are bent parallel to the electrode substrate 11 to generate connection members 14, thereby providing a three-dimensional electrode unit 15 having the 15 pieces of the elastic electroconductive sections 13 (FIG. 1*b*).

Figure 1B:
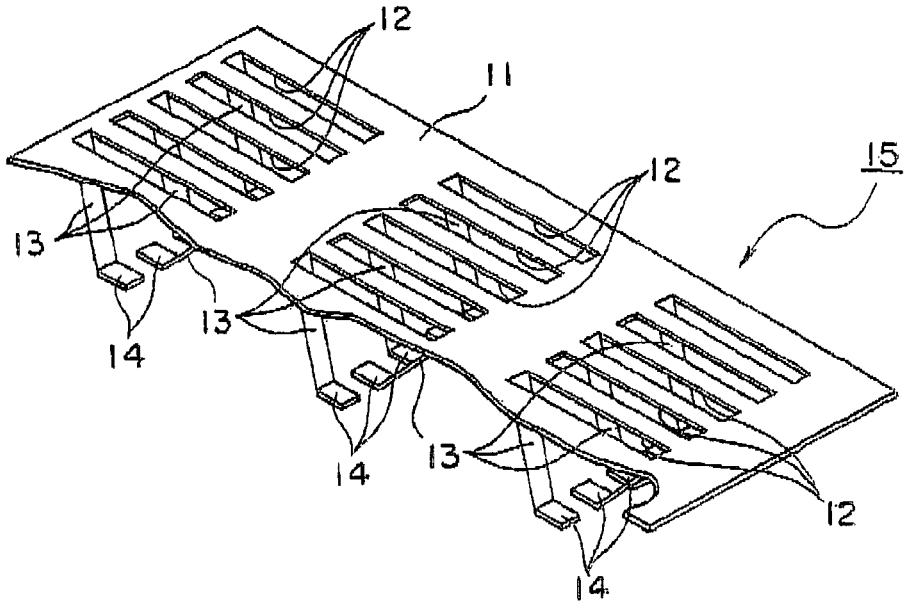
FIG. 1*b* is a partially broken perspective view showing a three-dimensional electrode in which elastic electroconductive sections are formed by bending the snicks shown in FIG. 1*a*.
Figure 2:
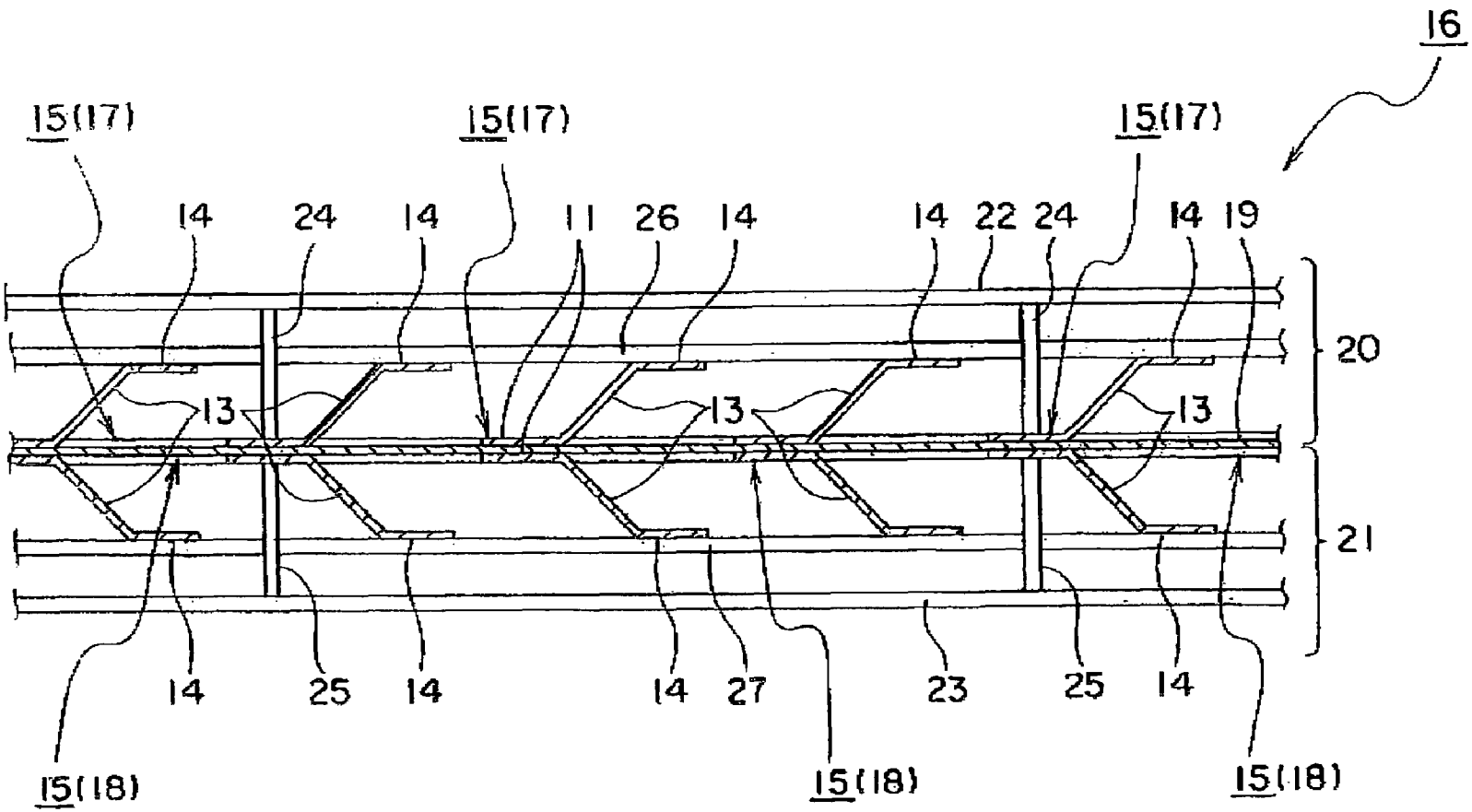
FIG. 2 is a partial horizontal section showing an ion exchange membrane electrolytic cell mounting the three-dimensional electrode of FIG. 1*b*.

An ion exchange membrane electrolytic cell 16 shown in FIG. 2 is exemplified to use three units of the three-dimensional electrode units 15 shown in FIG. 1*b* as an anode 17 and a cathode 18. The respective top surface sides (those having no electroconductive sections) of the three-dimensional electrode units acting as the anode and the cathode are in tight contact with an ion exchange membrane 19, and the respective shorter sides are in contact with the shorter sides of the adjacent three-dimensional electrode unit 15 to configure the three-dimensional electrode.

The ion exchange membrane electrolytic cell 16 includes an anode current collector 22 and a cathode current collector 23 in the anode chamber 19 and the cathode chamber 20, respectively. A first anode current supplying plate 24 connects the contact section of the adjacent three-dimensional electrode units 15 in the anode 17 side with the anode current collector 22, and a first cathode current supplying plate 25 connects the contact section of the adjacent three-dimensional electrode units 15 in the cathode 18 side with the cathode current collector 23.

The first anode current supplying plates 24 are electrically connected with each other by a second anode current supplying plate 26. All of the connection members 14 of the three-dimensional electrode units 15 in the anode side are electrically connected to the second anode current supplying plate 26, thereby exerting an external force in the direction toward the ion exchange membrane 19 onto the elastic electroconductive sections 13. Further, the first cathode current supplying plates 25 are electrically connected with each other by a second cathode current supplying plate 27. All of the connection members 14 of the three-dimensional electrode units 15 in the cathode side are electrically connected to the second cathode current supplying plate 27, thereby exerting an external force toward the direction of the ion exchange membrane 19 onto the elastic electroconductive sections 13.

When brine is supplied to the anode chamber 20 of the electrolytic cell 16 and diluted caustic soda aqueous solution is supplied to the cathode chamber 21 with current supply, dense caustic soda aqueous solution is obtained in the cathode chamber.

Since each of the elastic electroconductive sections 13 of the three-dimensional electrode units 15 provides resilience to the entire electrode so that the electrode functions with high strength and high toughness, and a stable operation for a longer period of time is enabled.

Figure 3:
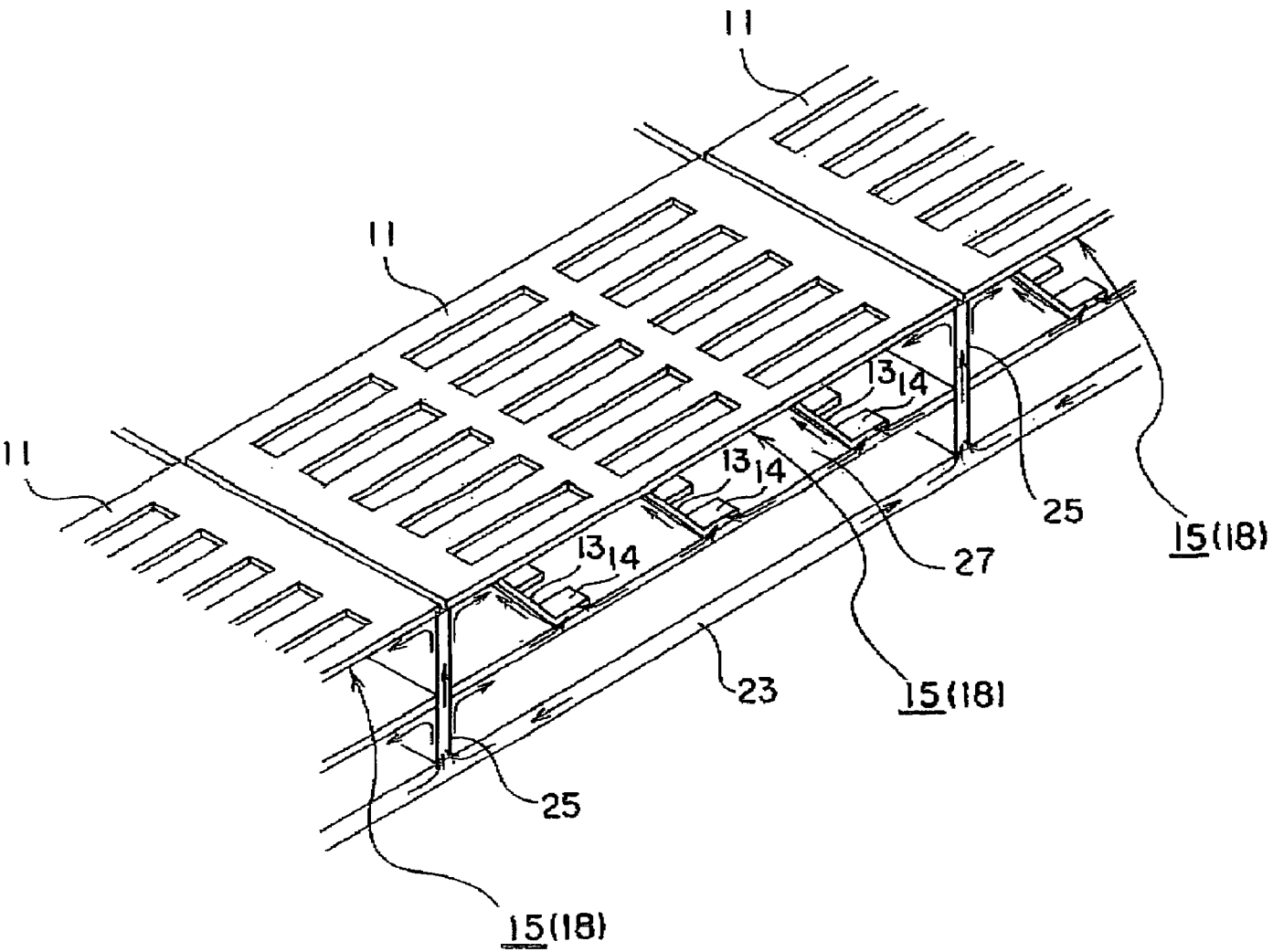
FIG. 3 is a perspective view showing the current flow in the cathode chamber of the ion exchange membrane electrolytic cell of FIG. 2.

Further, as shown in FIG. 3, the current is directly supplied to a contact section between the adjacent three-dimensional electrode units 15 through the cathode current collector 23 and the first cathode current supplying plate 25. On the other hand, the current supplied to the first cathode current supplying plate 25 is branched to the second cathode current supplying plate 27 to be supplied to the surface of the three-dimensional electrode 15 through the connection members 14 and the elastic electroconductive sections 13 connected to the above second cathode current supplying plate 27. Accordingly, a plurality of the current supplying paths are present so that the current is securely supplied.

The three-dimensional electrode or the three-dimensional electrode unit is not restricted to that depicted in FIG. 1*b*, and various modifications are possible such as those shown in FIG. 4 to 11, wherein description of the same element as that in FIG. 1*a* is omitted by attaching the same numeral thereto.

Figure 4:
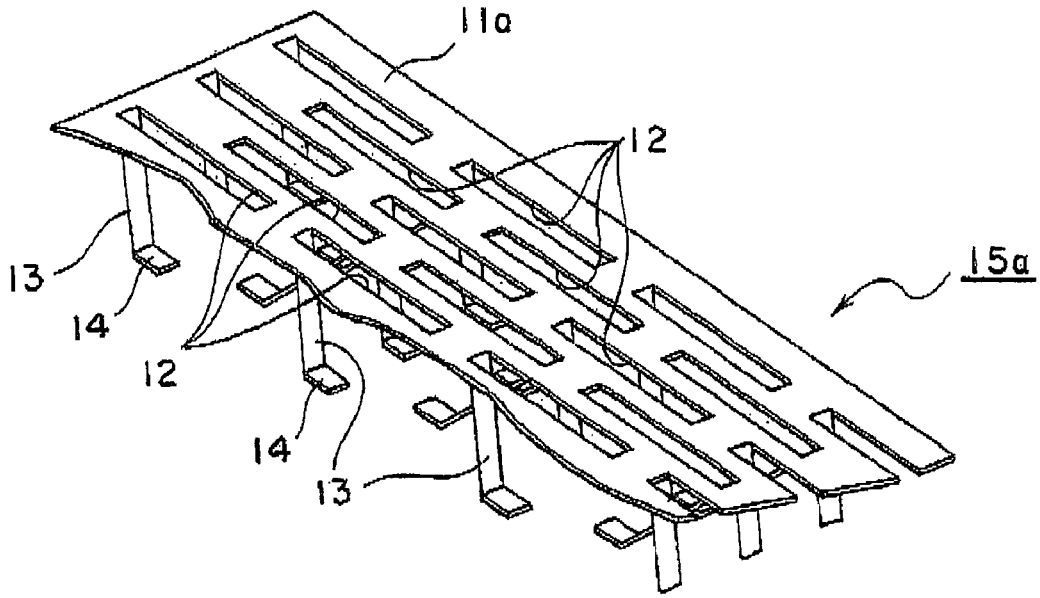
FIG. 4 is a first alternative of the electrode substrate.

A first modification shown in FIG. 4 is, different from that of FIG. 1*a*, a three-dimensional electrode 15*a* in which snicks 12*a* are staggered.

Figure 5:
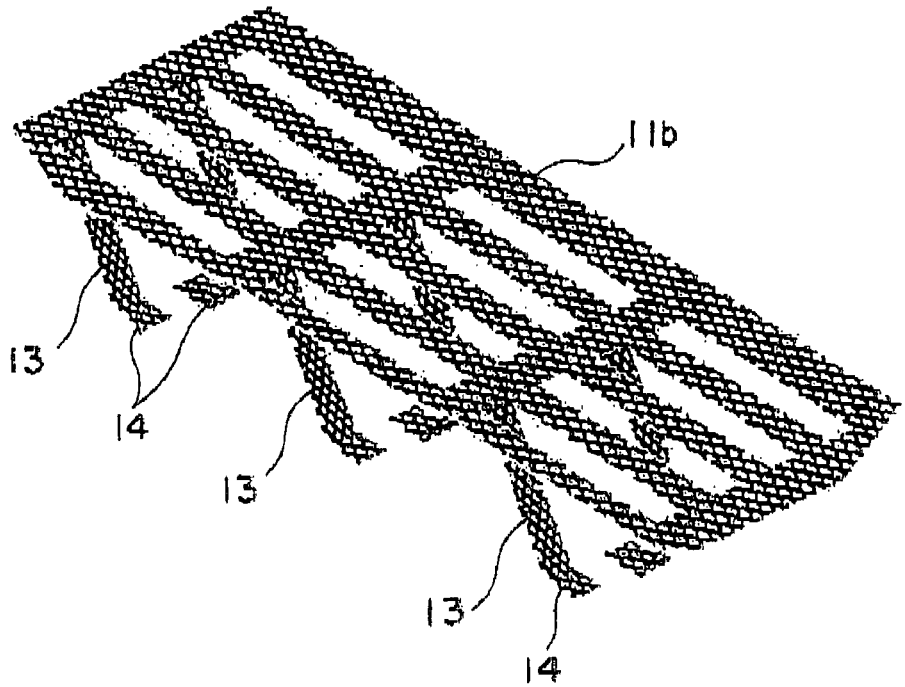
FIG. 5 is a second alternative of the electrode substrate.

A second modification shown in FIG. 5, different from the non-porous electrode substrate shown in FIG. 1*a*, employs a porous electrode substrate 11*b* such as expanded metal.

Although not shown herein, snicks may be staggered in a porous electrode substrate.

Figure 6:
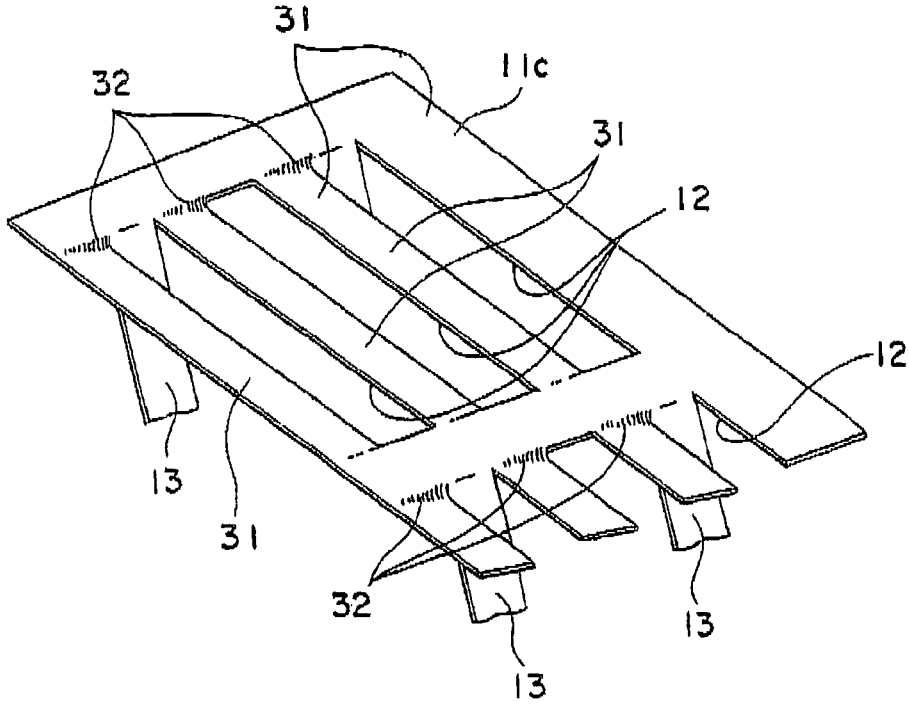
FIG. 6 is a third alternative of the electrode substrate.

A third modification shown in FIG. 6 is an electrode substrate 11*c* which is plastically deformed such that louver-like inclinations 82 are formed on both ends of oblong sections 31 between the adjacent bottom ends of the elastic electroconductive sections 13.

Figure 7:
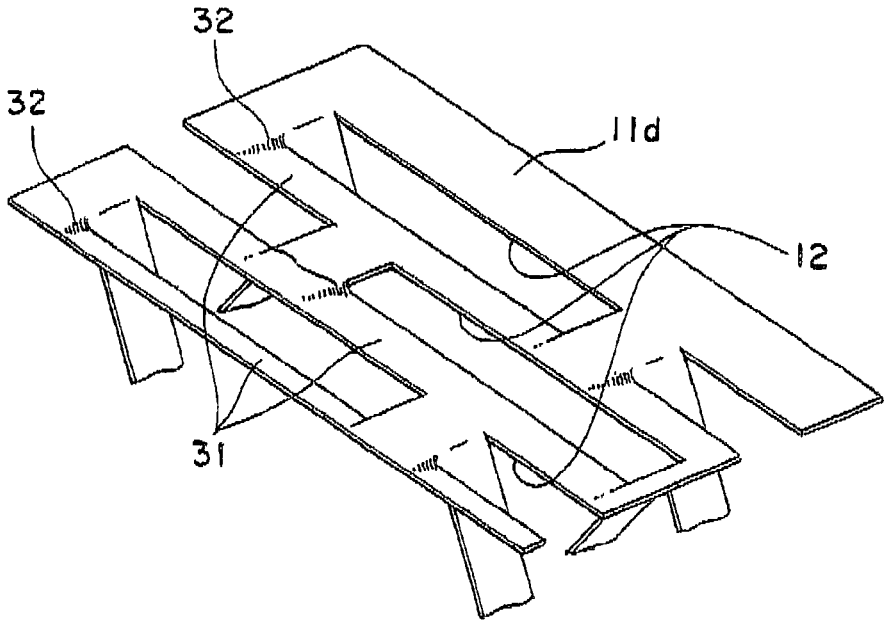
FIG. 7 is a forth alternative of the electrode substrate.

A fourth modification shown in FIG. 7 is an electrode substrate 11*d* which is plastically deformed such that louver-like inclinations 32 are formed on the oblong sections 31 adjacent to the end of the snicks 12 of the three-dimensional electrode 15 of FIG. 1*b*.

Although not shown herein, the porous electrode substrate may be plastically deformed such that louver-like inclinations are formed.

Figure 8:
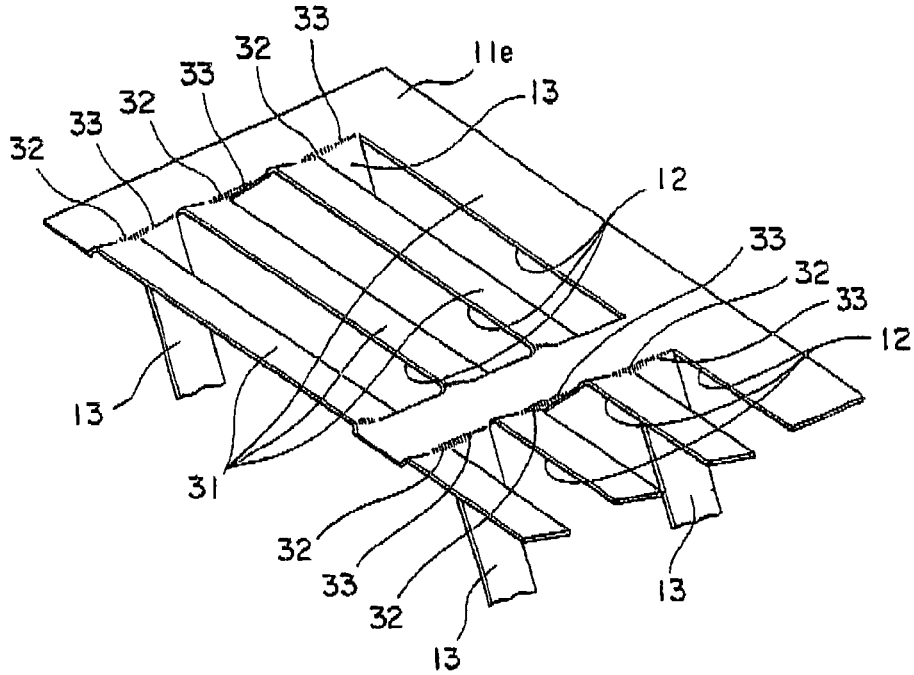
FIG. 8 is a fifth alternative of the electrode substrate.

A fifth modification shown in FIG. 8 is an improvement of the third modification shown in FIG. 6. This modification is an electrode substrate 11*e* which is plastically deformed such that, in addition to the louver-like inclinations 32 on the both ends of the oblong sections 31, louver-like inclinations 33 facing to the opposite direction with respect to the louver-like inclinations 32 are formed on the base ends of the elastic electroconductive sections 13 and the other ends of the snicks 12.

Although not shown herein, the porous electrode substrate or the electrode substrate having the staggered snicks may be plastically deformed such that louver-like inclinations 32, 33 are formed.

Figure 9:
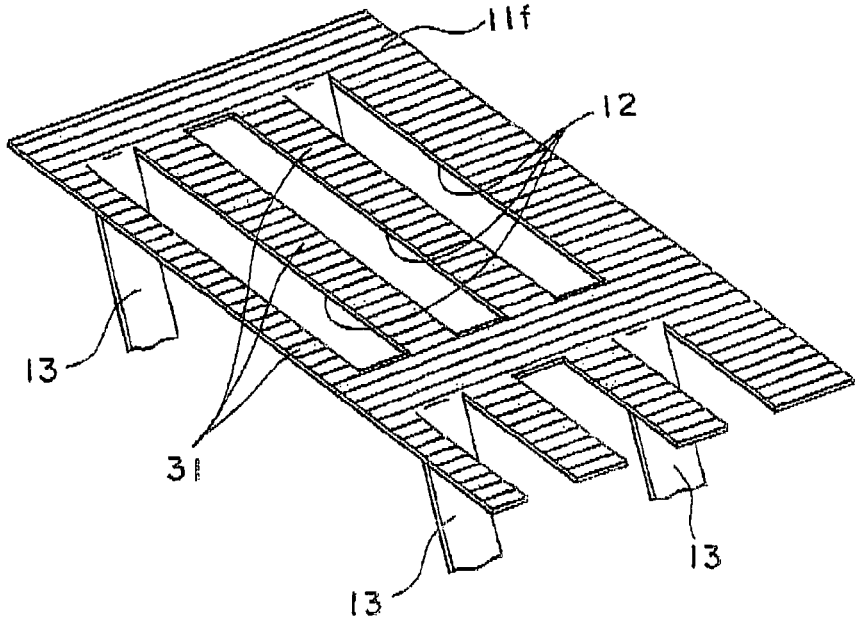
FIG. 9 is a sixth alternative of the electrode substrate.

A sixth modification shown in FIG. 9 is, in place of the electrode substrate of FIG. 1*a*, an example of an electrode substrate 11*f* to which the knurling is subjected except for the electroconductive sections 13 and the connection members 14.

Although not shown herein, the porous electrode substrate or the electrode substrate having the staggered snicks may be subjected to the knurling.

Figure 10:
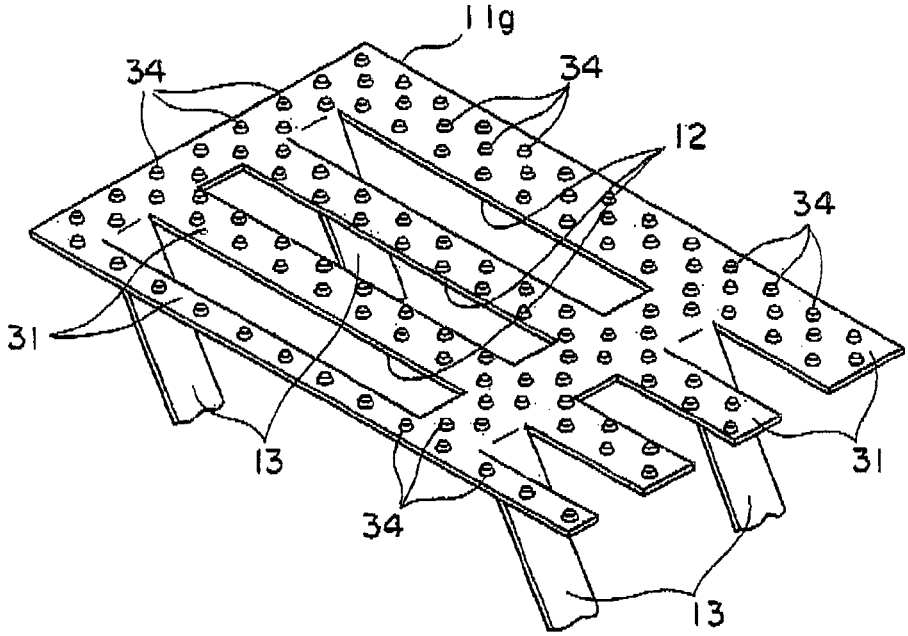
FIG. 10 is a seventh alternative of the electrode substrate.

A seventh modification shown in FIG. 10 is an electrode substrate 11*g* having a plenty of dancette projections 84 with smaller diameters bonded thereto except for its electroconductive sections 13 and its connection members 14 of the electrode substrate of FIG. 1*b*.

Although not shown herein, the dancette projections 34 may be bonded to the porous electrode substrate or the electrode substrate having the staggered snicks.

Figure 11:
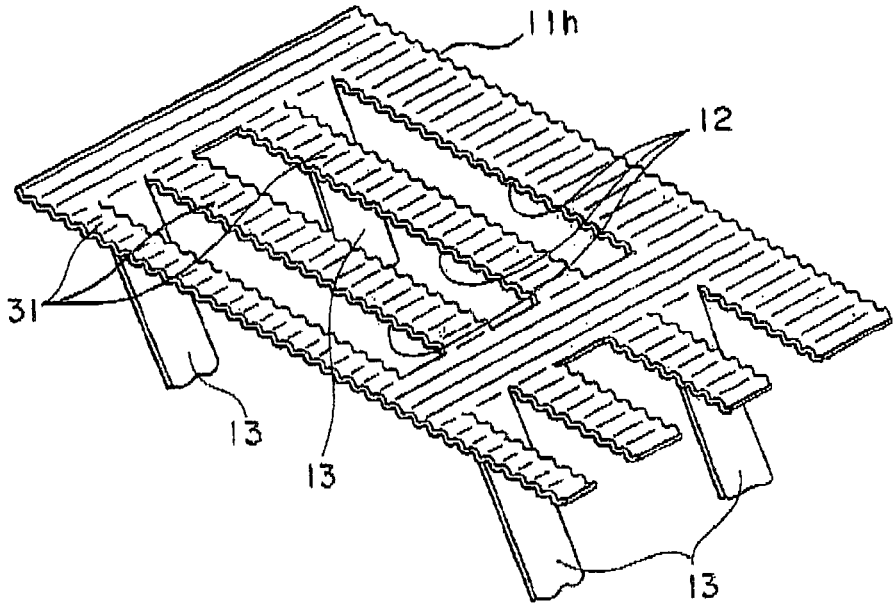
FIG. 11 is an eighth alternative of the electrode substrate.

An eighth modification shown in FIG. 11 is an electrode substrate 11*h* to which corrugation processing is subjected, in place of the knurling.

Although not shown herein, the porous electrode substrate or the electrode substrate having the staggered snicks may be subjected to the corrugation processing.

Although Examples of the three-dimensional electrode and the ion exchange membrane in accordance with the present invention will be described, the present invention shall not be deemed to be restricted thereto.

Example 1

A unit ion exchange membrane electrolytic cell was assembled as follows.

A dimensionally stable electrode (DSE) for brine electrolysis having an effective electrode area of 1540 $cm^2$ (width of 11 cm×height of 140 cm) and requiring a lower amount of oxygen available from Permelec Electrode, Ltd. was used as an anode. The anode was welded to an anode chamber partition wall by using an anode rib.

An expanded metal cathode current collector prepared by electroless-plating nickel on copper alloy and further plating Raney nickel catalyst thereon in dispersion state was mounted on a cathode chamber partition wall by using a cathode rib made of plate-like nickel.

A copper alloy plate having length of 110 mm, width of 350 mm and thickness of 0.2 mm was used as an electrode substrate of a three-dimensional electrode unit. After the copper alloy plate was shaped to expanded metal, snicks having breadth of 2 mm and length of 9 mm were formed in 36 rows each having six pieces with a pitch of 5 mm by using the press working.

Thereafter, all the surfaces of the copper alloy plate were subjected to electroless nickel-plating and Raney nickel catalyst was plated by using nickel in the dispersion state, thereby supporting electrode catalyst thereon.

Then, each of the snicks was bent toward the same direction at an angle of 45 degree to form an elastic electroconductive section, and the front end thereof was bent so as to be parallel to the electrode substrate, thereby providing the three-dimensional electrode unit.

The four three-dimensional electrode units were arranged and in contact with one another on the cathode current collector.

An ion exchange membrane (Flemion-F8020, available from Asahi Glass Co., Ltd) was positioned between the anode and the cathode to assemble an ion exchange membrane electrolytic cell.

Electrolysis was conducted at current density of 40 A/dm$^2$ and temperature of 85° C. while brine having concentration of 302 g/liter was supplied to the anode chamber and caustic soda aqueous solution having concentration of 82% in weight was supplied to the cathode chamber. A cell voltage was 2.949 V.

Example 2

An anode and an anode chamber were the same as those of Example 1.

An expanded metal cathode current collector made of nickel was mounted on a cathode chamber partition wall by using a cathode rib made of plate-like nickel.

A nickel plate having length of 110 mm, width of 350 mm and thickness of 0.2 mm was used as an electrode substrate of a three-dimensional electrode unit. After the nickel plate was shaped to expanded metal, snicks having breadth of 2 mm and length of 9 mm were formed in 36 rows each having six pieces with a pitch of 5 mm by using the press working.

Thereafter, the nickel plate was plated with Raney nickel catalyst by using nickel in the dispersion state, thereby supporting electrode catalyst thereon.

Then, each of the snicks was bent toward the same direction at an angle of 45 degree to form an elastic electroconductive section, and the front end thereof was bent so as to be parallel to the electrode substrate, thereby providing the three-dimensional electrode unit.

The four three-dimensional electrode units were arranged and in contact with one another on the cathode current collector.

The ion exchange membrane (Flemion-F8020, available from Asahi Glass Co., Ltd) was positioned between the anode and the cathode to assemble an ion exchange membrane electrolytic cell.

Electrolysis was conducted at current density of 40 A/dm$^2$ and temperature of 85° C. while brine having concentration of 304 g/liter was supplied to the anode chamber and caustic soda aqueous solution having concentration of 32% in weight was supplied to the cathode chamber. A cell voltage was 2.942 V.

Example 3

A unit ion exchange membrane electrolytic cell was assembled as follows.

A cathode was prepared by plating Raney nickel catalyst on expanded metal made of nickel in dispersion state for supporting the catalyst thereon. The effective area of the cathode was 1540 cm$^2$ (width of 11 cm×height of 140 cm). The cathode was mounted on a cathode chamber partition wall of the electrolytic cell by using a cathode rib.

An expanded metal anode current collector made of titanium was mounted on an anode chamber partition wall by using an anode rib made of plate-like titanium.

A titanium plate having length of 110 mm, width of 350 mm and thickness of 0.5 mm was used as an electrode substrate of a three-dimensional electrode unit. After the titanium plate was shaped to expanded metal, snicks having breadth of 2 mm and length of 9 mm were formed in 36 rows each having six pieces with a pitch of 5 mm by using the press working.

Thereafter, $RuO_2$—$Ti_2O$-based catalyst was supported on the entire surfaces of the titanium plate by means of the thermal decomposition method.

Then, each of the snicks was bent toward the same direction at an angle of 45 degree to form an elastic electroconductive section, and the front end thereof was bent so as to be parallel to the electrode substrate, thereby providing the three-dimensional electrode unit (anode).

The four three-dimensional electrode units were arranged and in contact with one another on the anode current collector.

The ion exchange membrane (Flemion-F8020, available from Asahi Glass Co., Ltd) was positioned between the anode and the cathode to assemble an ion exchange membrane electrolytic cell.

Electrolysis was conducted at current density of 40 A/dm$^2$ and temperature of 85° C. while brine having concentration of 302 g/liter was supplied to the anode chamber and caustic soda aqueous solution having concentration of 32% in weight was supplied to the cathode chamber. A cell voltage was 2.940 V.

Example 4

A unit ion exchange membrane electrolytic cell was assembled under the same conditions of those of Example 3 except that the titanium plate which was the electrode substrate of the three-dimensional electrode unit (anode) was not shaped to the expanded metal but was used as the plate itself.

Electrolysis was conducted at current density of 40 A/dm$^2$ and temperature of 85° C. while brine having concentration of 303 g/liter was supplied to the anode chamber and caustic soda aqueous solution having concentration of 32% in weight was supplied to the cathode chamber. A cell voltage was 2.990 V.

Comparative Example 1

An ion exchange membrane electrolytic cell was assembled as follows by using an electrode having no three-dimensional structure.

A cathode was prepared by plating Raney nickel catalyst on expanded metal made of nickel in dispersion state for supporting the catalyst thereon. The effective area of the cathode was 1540 cm$^2$ (width of 11 cm×height of 140 cm). The cathode was mounted on a cathode chamber partition wall of the electrolytic cell by using a cathode rib.

A dimensionally stable electrode (DSE) for brine electrolysis having an effective area of 1540 cm$^2$ (width of 11 cm×height of 140 cm) and requiring a lower amount of oxygen available from Permelec Electrode, Ltd. was used as an anode. The anode was welded to an anode chamber partition wall by using an anode rib.

A cation exchange membrane (Flemion-F8020, available from Asahi Glass Co., Ltd) was positioned between the anode and the cathode to assemble the ion exchange membrane electrolytic cell.

Electrolysis was conducted at current density of 40 A/dm$^2$ and temperature of 85° C. while brine having concentration of 304 g/liter was supplied to the anode chamber and caustic soda aqueous solution having concentration of 32% in weight was supplied to the cathode chamber. A cell voltage was 3.185 V.

Example 5

A unit ion exchange membrane electrolytic cell was assembled as follows.

A cathode was prepared by plating Raney nickel catalyst on expanded metal made of nickel in dispersion state for supporting the catalyst thereon. The effective area of the cathode was 20 $cm^2$ (width of 4 cm×height of 5 cm). The cathode was welded on a cathode chamber partition wall of the electrolytic cell by using a cathode rib.

An expanded metal anode current collector prepared by electroless-plating nickel on copper alloy and further plating Raney nickel catalyst thereon in dispersion state was mounted on an anode chamber partition wall by using an anode rib made of plate-like nickel.

A copper alloy plate having length of 50 mm, width of 40 mm and thickness of 0.2 mm was used as an electrode substrate of a three-dimensional electrode unit. After the copper alloy plate was shaped to expanded metal, snicks having breadth of 2 mm and length of 9 mm were formed in 10 rows each having four pieces with a pitch of 5 mm by using the press working.

Thereafter, all the surfaces of the copper alloy plate were subjected to electroless nickel-plating, and then Raney nickel catalyst was plated by using nickel in the dispersion state, thereby supporting electrode catalyst thereon.

Then, each of the snicks was bent toward the same direction at an angle of about 45 degree to form an elastic electroconductive section, and the front end thereof was bent so as to be parallel to the electrode substrate, thereby providing the three-dimensional electrode unit.

The three-dimensional electrode unit was arranged on the anode current collector.

A fluorine resin-based ion exchange membrane (Flemion, available from Asahi Glass Co., Ltd) was positioned between the anode and the cathode to assemble an ion exchange membrane electrolytic cell.

Pseudo white liquor was prepared by adding 20 ppm of suspended solids acting as impurities to sodium sulfide aqueous solution having concentration of 30 g/liter.

After the anode chamber was filled with the pseudo white liquor and the cathode chamber was filled with caustic soda aqueous solution having concentration of 10% in weight, electrolysis was conducted at temperature of 84 to 86° C. while current density was changed in a range from 0.5 to 6 $KA/m^2$. The relation between the current densities and the cell voltages (current-voltage curve) is shown by "A" in a graph of FIG. 12.

Comparative Example 2

An ion exchange membrane electrolytic cell was assembled as follows by using an electrode having no three-dimensional structure. The cathode as the same as that of Example 5 was used.

Nickel foam having an average pore size of 0.8 mm, a surface area of 2500 $m^2/m^3$, length of 50 mm, width of 40 mm and thickness of 2.0 mm was used as the anode, in place of the three-dimensional electrode of Example 5.

Figure 12:
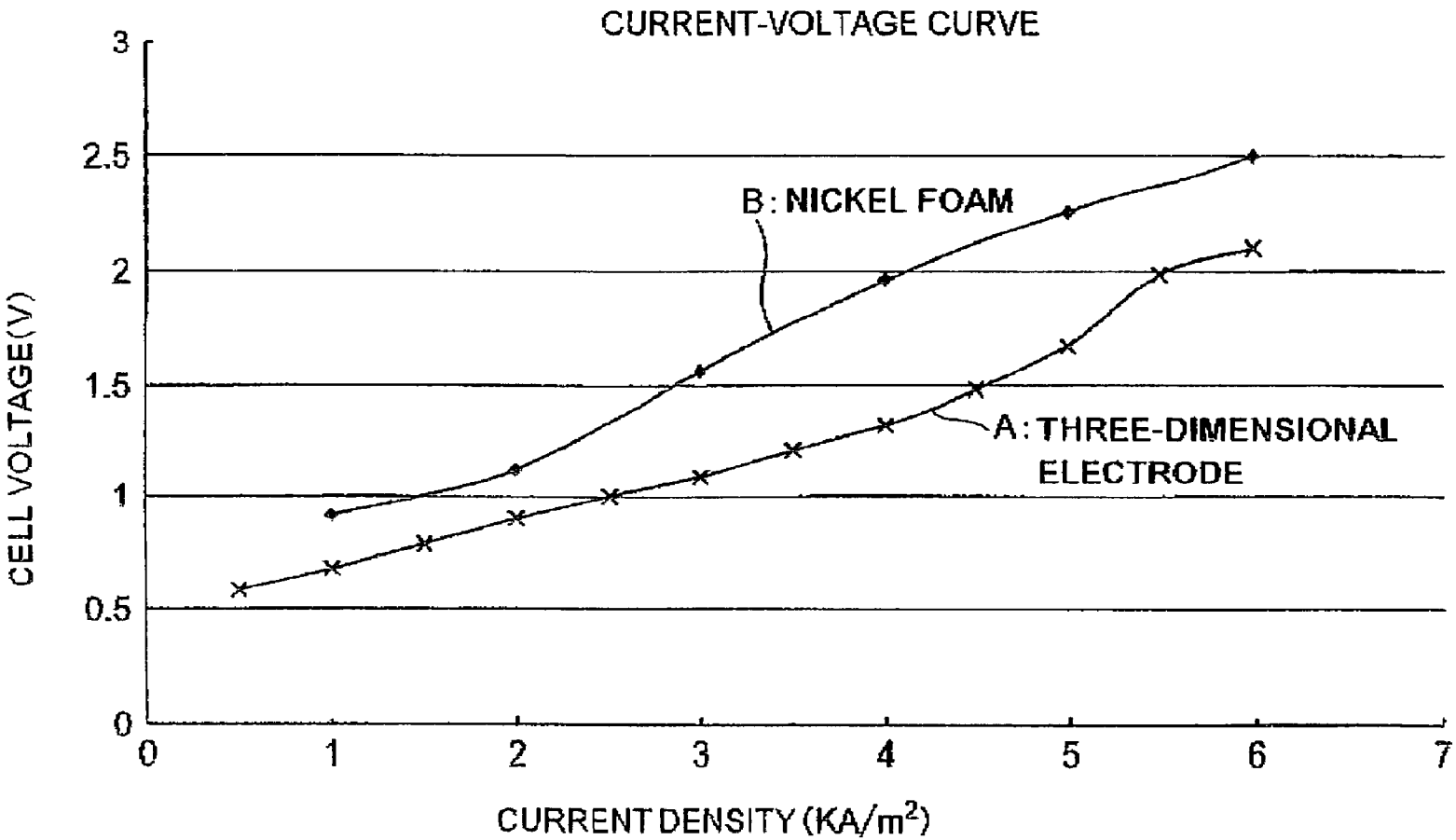
FIG. 12 is a graph showing relations between current densities and cell voltages in Example 5 and Comparative Example 2.

The relation between the current densities and the cell voltages measured under the same conditions as those of Example 5 is shown by "B" in the graph of FIG. 12.

As apparent from the graph of FIG. 12, at the respective current densities, the cell voltages of the three-dimensional electrode of Example 1 were lower than those of the nickel foam of Comparative Example 2 by 0.2 to 0.7 V.

Since the above embodiments are described only for examples, the present invention is not limited to the above embodiments and various modifications or alternations can be easily made therefrom by those skilled in the art without departing from the scope of the present invention.

What is claimed is:

1. An ion exchange electrolytic cell comprising:

an anode chamber including an anode and a cathode chamber including a cathode separated by an ion exchange membrane, and an anode current collector and a cathode current collector;

at least one of the anode and the cathode being a three-dimensional electrode for electrolysis including a plate-shaped metal electrode substrate supporting electrode catalyst and having a plurality of snicks, and a plurality of elastic electroconductive sections which are formed by bending the plurality of the snicks toward the same direction with respect to the electrode substrate, and the electrode substrate being in tight contact with the ion exchange membrane, and the elastic electroconductive sections being in contact with at least one of the anode current collector and the cathode current collector, thereby providing resilience to the entire electrode without mounting an additional resilient element so that the electrode is retained at the fixed position by means of its own elasticity free of any additional resilient element.

2. An ion exchange electrolytic cell comprising:

an anode chamber including an anode formed as a three-dimensional electrode;

a cathode chamber including a cathode formed as a three-dimensional electrode;

an ion exchange membrane separating the anode chamber and the cathode chamber;

an anode current collector and a cathode current collector;

an anode current collector; and a cathode current collector, wherein each of the anode and the cathode is comprised of a non-porous metallic electrode substrate in contact with the ion exchange membrane;

plural oblong snicks aligned in plural rows on each electrode substrate, each row having plural snicks orientating toward a same direction, two adjacent snicks belonging to different rows facing to opposite directions, each snick extending in a same direction with respect to the electrode substrate and defining an elastic electroconductive section, front ends of each elastic electroconductive section bent parallel to the electrode substrate and defining connection members, each connection member in contact with one of i) the anode current collector and ii) the cathode current collector, each elastic electroconductive section providing resilience to the corresponding three-dimensional electrode.

3. An ion exchange electrolytic cell comprising:

an ion exchange membrane;

an anode chamber including an anode formed as a three-dimensional electrode;

a cathode chamber including a cathode formed as a three-dimensional electrode;

an anode current collector and a cathode current collector;

an anode current collector; and a cathode current collector, wherein each of the anode and the cathode is comprised of a non-porous metallic electrode substrate in contact with the ion exchange membrane;

at least one of the anode and the cathode further comprises plural oblong snicks, the snicks orientating toward a same direction with respect to the electrode substrate and defining an elastic electroconductive section, front ends of each elastic electroconductive section bent parallel to the electrode substrate and defining connection members, each connection member in contact with one of i) the anode current collector and ii) the cathode current collector, each elastic electroconductive section defining a resilience member.

* * * * *